US012152285B2

(12) United States Patent
Paulin

(10) Patent No.: US 12,152,285 B2
(45) Date of Patent: Nov. 26, 2024

(54) METHOD FOR THERMAL PROCESSING BULLETS

(71) Applicant: Peter Paulin, Decatur, IL (US)

(72) Inventor: Peter Paulin, Decatur, IL (US)

( * ) Notice: Subject to any disclaimer, the term of this patent is extended or adjusted under 35 U.S.C. 154(b) by 0 days.

(21) Appl. No.: 16/706,616

(22) Filed: Dec. 6, 2019

(65) Prior Publication Data

US 2020/0181723 A1 Jun. 11, 2020

Related U.S. Application Data

(60) Provisional application No. 62/776,091, filed on Dec. 6, 2018.

(51) Int. Cl.
*C21D 1/613* (2006.01)
*F42B 33/14* (2006.01)

(52) U.S. Cl.
CPC ..... *C21D 1/613* (2013.01); *F42B 33/14* (2013.01); *C21D 2201/05* (2013.01); *C21D 2281/02* (2013.01)

(58) Field of Classification Search
CPC . C21D 1/56; C21D 1/60; C21D 1/613; C21D 2281/02; F42B 39/24
See application file for complete search history.

(56) References Cited

U.S. PATENT DOCUMENTS 4,613,370 A * 9/1986 Held ..... C22C 1/045 102/306
5,048,162 A * 9/1991 Nelson ..... C21D 8/105 86/19.5
5,259,200 A * 11/1993 Kamody ..... C21D 6/04 148/578
5,865,913 A * 2/1999 Paulin ..... C21D 9/12 148/577
6,164,961 A * 12/2000 Luscher ..... A21B 1/42 198/465.1
2002/0179204 A1* 12/2002 Brunson ..... C21D 1/785 148/578
2007/0281176 A1* 12/2007 Palumbo ..... F41H 5/0457 473/578
2016/0010919 A1* 1/2016 Paulin ..... F27B 9/2461 432/11
2018/0051751 A1* 2/2018 Qian ..... C21D 1/613
2019/0093188 A1* 3/2019 Chandler ..... F25D 3/10

* cited by examiner

*Primary Examiner* — Keith Walker
*Assistant Examiner* — Ryan L Heckman
(74) *Attorney, Agent, or Firm* — Law Office of Jerry Joseph, PLC; Jerry Joseph

(57) ABSTRACT

A method for thermal processing bullets to yield a refined grain structure, the method includes obtaining one or more bullets, disposing the one or more bullets within a chamber having a temperature gradient between ambient temperature and cryogenic temperature, the chamber having a plurality of temperature zones, moving the one or more bullets between the plurality of temperature zones of the chamber at a predetermined rate, and returning the one or more bullets to the ambient temperature.

20 Claims, 9 Drawing Sheets

METHOD FOR THERMAL PROCESSING BULLETS

BACKGROUND OF THE INVENTION

1. Field of the Invention

The present general inventive concept relates to bullet processing. More specifically, it relates to a system and method for thermal processing bullets, for refining the grain structure by using a continuous cooling process from room temperatures to subzero temperatures and then back to room temperatures, without interruption.

2. Background

Grains make up the crystalline structure of metals and most grains are not even visible to the human eye. Many molten metals are 'cold worked' between heavy rollers after it has been removed from a furnace. Cold working compresses the metal and elongates the grain structures in a single direction causing strain hardness and tensile strength to increase. Steel can be heated and cooled in ambient air to reduce grain size and make them more uniform. This process makes the steel 'tougher.' Rapid cooling of heated steel (called 'quenching') and then reheating (called 'tempering') increases the amount of carbon in the grains making it much harder. Heating, quenching and tempering processes involves heating chambers, cooling baths and conveyors and this multi-step process can take time.

Temperature treating metals for products such as ammunitions can play a role in bullet performance. Ammunitions intended for high-velocity applications generally have a lead core that is jacketed or plated with a gilding metal such as nickel, copper and steel. This thin layer of harder metal protects the softer lead core when the ammunition passes through the barrel and during flight, which allows delivering the ammunition intact to the target. Steel ammunitions are often plated with copper or other metals for corrosion resistance during long periods of storage. Thermally tempering the material or altering the materials structure forms an austenite structure into a microstructure that is stable at room temperature during a force-cooling process that is known to harden the metal.

Ammunitions with soft jackets will swell (obturate) more against the bore interior of a weapon. This obturation will increase friction and therefore slow down the ammunition's acceleration. Subsequently, the ammunition will take longer to leave a gun barrel and will arrive at a target later than ammunition having a harder jacket.

Therefore, what is needed is a method and system for thermal processing of bullets that continuously cools components down to subzero temperatures and back to room temperatures that results in a decrease in molecular stresses thereby increasing in coherence and granular structure of the ammunition. This process ultimately leads to bullet performance enhancements such as increased axial symmetry and concentricity during flight.

SUMMARY OF THE INVENTION

Certain of the foregoing and related aspects are readily attained according to the present general inventive concept by providing a method for thermal processing of bullets which includes exposing the components at room temperatures to subzero temperatures within a predetermined range using cooling agents such as liquid and gaseous nitrogen.

Certain of the foregoing and related aspects are readily attained according to the present general inventive concept by also providing a means to increase stabilization of internal structure of the bullets.

Certain of the foregoing and related aspects are readily attained according to the present general inventive concept by also providing a means to increase stress relief of internal structure of the bullets.

Certain of the foregoing and related aspects are readily attained according to the present general inventive concept by also providing a means to increase uniformity of compressive stress in external perimeter of the bullets.

Certain of the foregoing and related aspects are readily attained according to the present general inventive concept by also providing a means to decrease molecular stresses thereby increasing coherence and granular structure of the bullets, including the bullet core and casing.

Certain of the foregoing and related aspects are readily attained according to the present general inventive concept by also providing a means to increase ammunition casing smoothness due to a more refined grain structure.

Certain of the foregoing and related aspects are readily attained according to the present general inventive concept by also providing a means to reduce adhesive stress between bullets and gun barrels translating to substantial increases in sealing capacities between said bullets and gun barrels, ultimately resulting in higher travel velocity, axial symmetry and concentricity of the bullet in flight.

Certain of the foregoing and related aspects are readily attained according to the present general inventive concept by also providing a system for cryogenic processing of bullets which includes a transporting means configured to move the bullets through a plurality of temperature gradients.

The transporting means may include a chain drive and/or a ball and screw mechanism or the like. However, the present general inventive concept is not limited thereto.

In contrast with conventional methods disclosed by the prior art, the present general inventive concept utilizes a thermal gradient using gaseous and/or liquid cooling agents to affect a desired temperature change, continuously and without interruption or requiring significant energy inputs as is conventionally performed, to the system. This novel approach provides unexpected results in the physical characteristics of the bullets, without the need for costly low temperature thermal processing as is conventionally used to achieve such characteristics. In addition, the method according to the present inventive concept provides significantly improved wear resistance, improved concentricity and increased hardness of the bullets.

BRIEF DESCRIPTION OF THE DRAWINGS

These and/or other aspects of the present general inventive concept will become apparent and more readily appreciated from the following description of the embodiments, taken in conjunction with the accompanying drawings of which.

DESCRIPTION OF THE PREFERRED EMBODIMENTS

Figure 1:
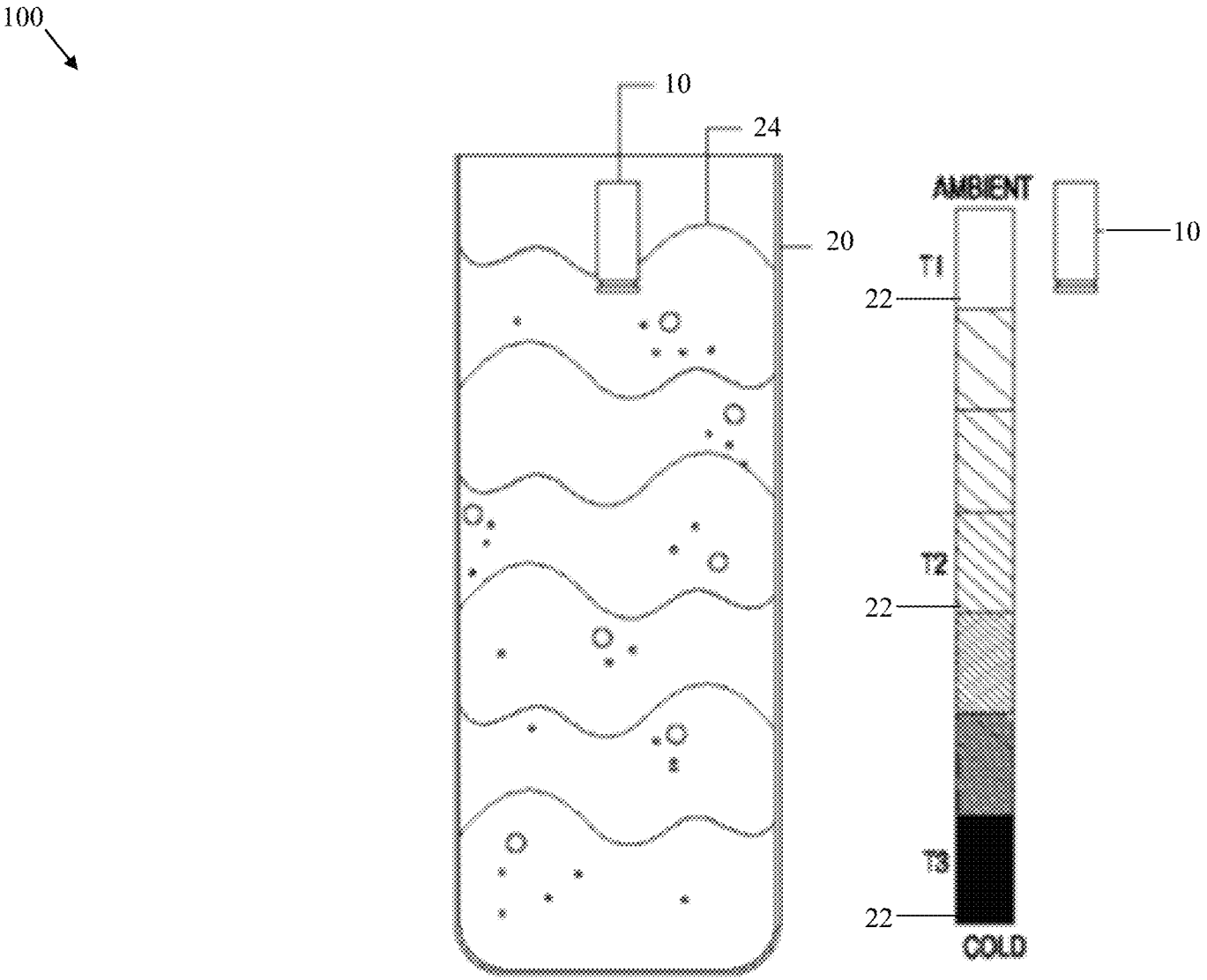
FIG. 1 illustrates a diagrammatic view of a bullet entering a temperature gradient.

The present inventive concept will now be described more fully with reference to the accompanying drawings, in which exemplary embodiments of the present general inventive concept are illustrated. The inventive concept may, however, be embodied in many different forms and should not be construed as being limited to the embodiments set forth herein; rather, these embodiments are provided so that this disclosure will be thorough and complete, and will fully convey the concept of the invention to those skilled in the art. Like reference numerals refer to like elements throughout.

The present general inventive concept includes methods and systems for thermally processing bullets that allows for the continuous cooling of the bullet from an ambient temperature down to, but not limited to about −300° F. and then back to ambient temperature, without stopping.

The present general inventive concept provides a method for thermal processing bullets to yield a refined grain structure, the method includes obtaining one or more bullet, disposing the one or more bullets within a chamber having a temperature gradient between ambient temperature and cryogenic temperature, the chamber having a plurality of temperature zones, moving the one or more bullets between the plurality of temperature zones of the chamber at a predetermined rate, and returning the one or more bullets to the ambient temperature.

FIG. 1 illustrates a diagrammatic view of bullet 10 entering a temperature gradient. In certain embodiments, said bullet 10 being comprised of, but not limited to cartridge case and bullet and the like made of a plurality of metal types such as but not limited to brass, cupronickel, copper alloys, and steel etc. A plurality of temperature gradients 22 being established by means of, but not limited to a chamber 20 containing cooling agents 24 such as, but not limited to liquid nitrogen, gaseous nitrogen and dry ice etc. therein. The figure showing bullet 10 entering temperature gradient T1. Said temperature gradient T1 including a first temperature zone ranging from about 60° F. to about 80° F.

Figure 2:
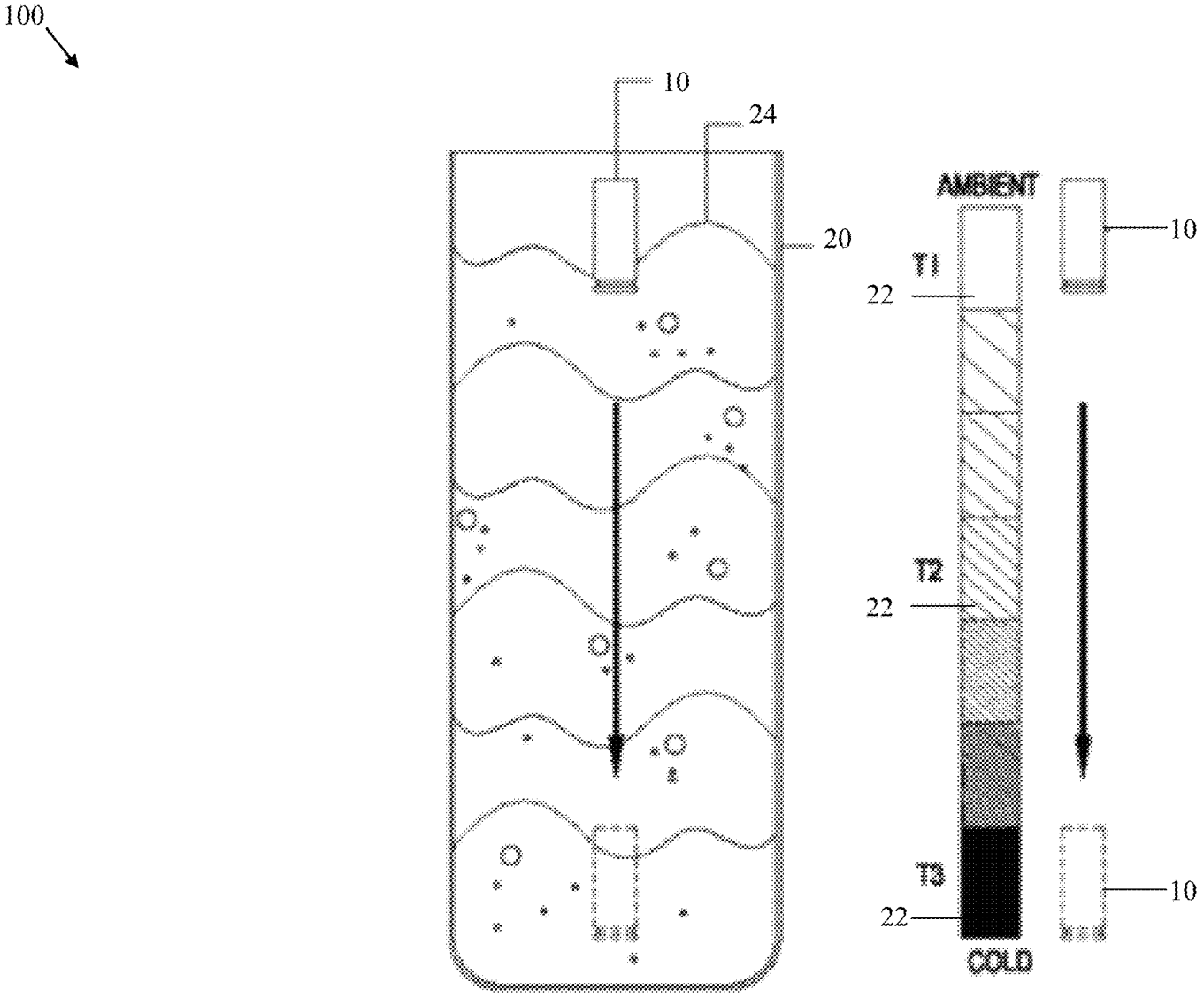
FIG. 2 illustrates a diagrammatic view of a bullet moving into a temperature gradient.

FIG. 2 illustrates a diagrammatic view of a bullet 10 moving into a temperature gradient T1, passing through temperature gradient T2 and arriving at temperature T3. Other embodiments may include either more or less gradients depending on desired outcomes. Said temperature gradient T2 being comprised of a cooling agent 24 at a temperature of, but not limited to from about −100° F. to about −250° F. Temperature gradient T3 being comprised of a cooling agent 24 at a temperature of, but not limited to from about −200° F. to about −500° F. Said bullets 10 can be transported into temperature gradients individually or as multiple groups of bullets 10.

Figure 3:
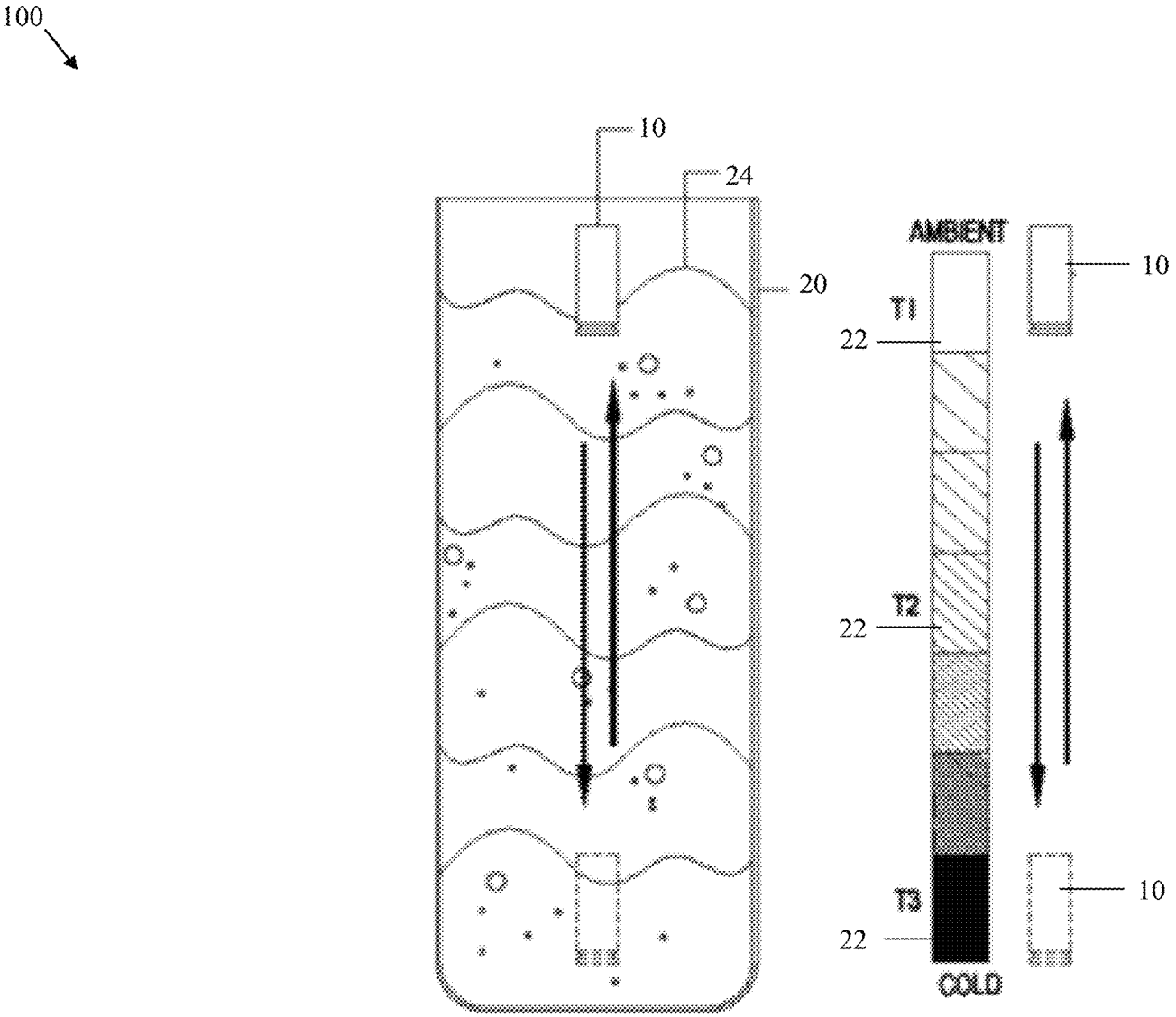
FIG. 3 illustrates a diagrammatic view of a bullet moving into and then out of a temperature gradient.

FIG. 3 illustrates a diagrammatic view of an bullet 10 moving into temperature gradients T1, T2, and T3 and then moving out said temperature gradients T1, T2, and T3. In other embodiments, bullets 10 may remain stationary and said cooling agents may be changed inside chamber 20. For example, in such an embodiment, temperature gradients first being established by introducing nitrogen gas to achieve temperature gradient T1 over a predetermined time and then introducing proportions of liquid nitrogen to achieve temperature gradient T2 over a predetermined time and then completely filling chamber 20 with liquid nitrogen to achieve temperature gradient T3 over a predetermined time. Other embodiments may incorporate other combinations of cooling agents, chambers and ammunition movements to obtain the desired aforementioned temperature gradient regimens. In embodiments wherein said bullets 10 being moved through temperature gradients inside a chamber or structure, the means of travel being performed by, but not limited to apparatuses such as ball screw mechanisms, pulley mechanisms, and conveyor mechanisms and the like. In addition, bullet 10 dwell times at the various temperature gradients T1, T2 and T3 may vary and a multitude of cooling cycles within the various said temperature gradients may also performed depending on the desired outcomes.

Figure 4:
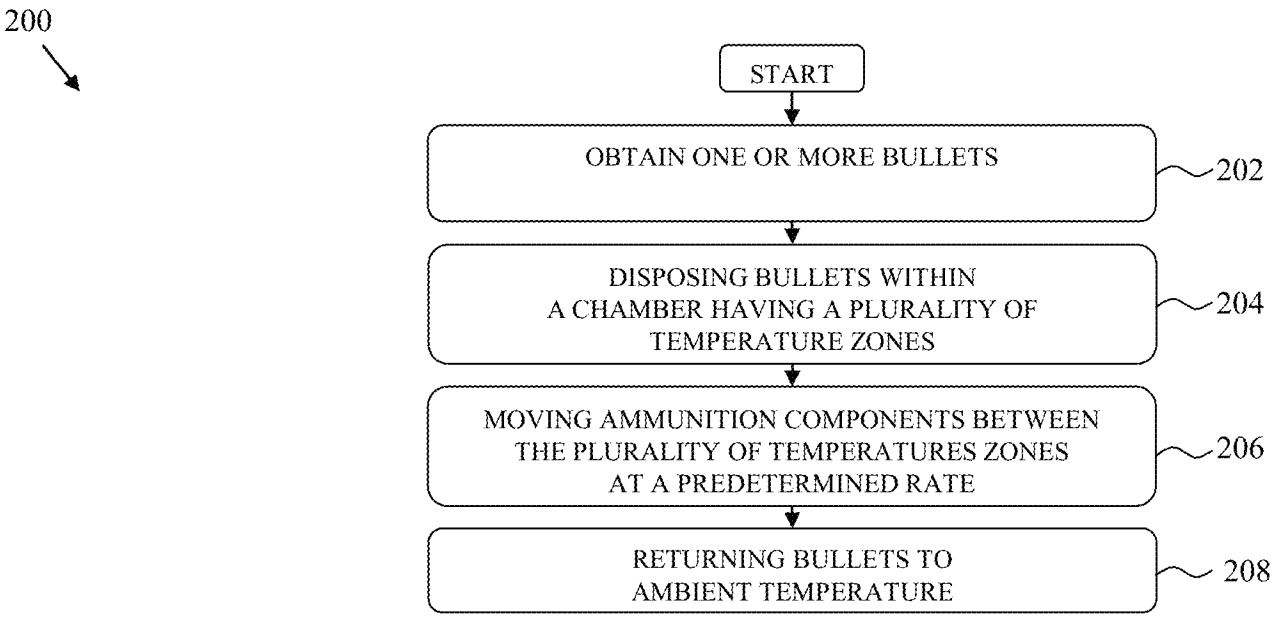
FIG. 4 illustrates a flow chart of an exemplary method of processing a bullet using a thermal processing system according to present general inventive concept.

FIG. 4 illustrates a flow chart of an exemplary method 200 of thermal processing ammunition using a thermal processing system 100 according to present general inventive concept.

In the present embodiment, the method 200 for thermal processing bullets to yield a refined grain structure begins at step 202 by obtaining one or more bullets.

At step 204, the one or more bullets are then disposed within a chamber having a temperature gradient between ambient temperature and cryogenic temperature, wherein the chamber has a plurality of temperature zones.

At step 206, the one or more bullets are moved between the plurality of temperature zones of the chamber at a predetermined rate. In the present exemplary embodiment, the predetermined rate is negative 2 degrees per minute. However, the present general inventive concept is not limited thereto.

At step 208, the one or more bullets are then returned to the ambient temperature.

In alternative embodiments, the chamber used within the method 200 includes a plurality of temperature zones includes a first temperature zone ranging from about 60° F. to about 80° F., a second temperature zone ranging from about 0° F., and a third temperature zone ranging from about −200° F. to about −500° F. In an alternative embodiment, the third temperature zone ranges from about −100° F. and below, however, the present general inventive concept is not limited thereto.

In exemplary embodiments, the chamber may include a temperature reducing agent such as liquid nitrogen, gaseous nitrogen, dry ice. However, the present general inventive concept is not limited thereto. The one or more bullets are moved between the plurality of temperature zones of the chamber using a mechanical means including a ball screw mechanism, a pulley mechanism, and a conveyor mechanism.

In exemplary embodiments, internal structures of the one or more bullets are stress relieved after being moved between the plurality of temperature zones and then back to the ambient temperature.

In exemplary embodiments, an external perimeter of the one or more bullets has a uniform compressive stress after being moved between the plurality of temperature zones and then back to the ambient temperature.

In exemplary embodiments, a grain size of the one or more bullets is less than 50 microns. However, the present general inventive concept is not limited thereto. That is, in alternative embodiments, the grain size of the one or more bullets is less than 10 microns.

Figure 5:
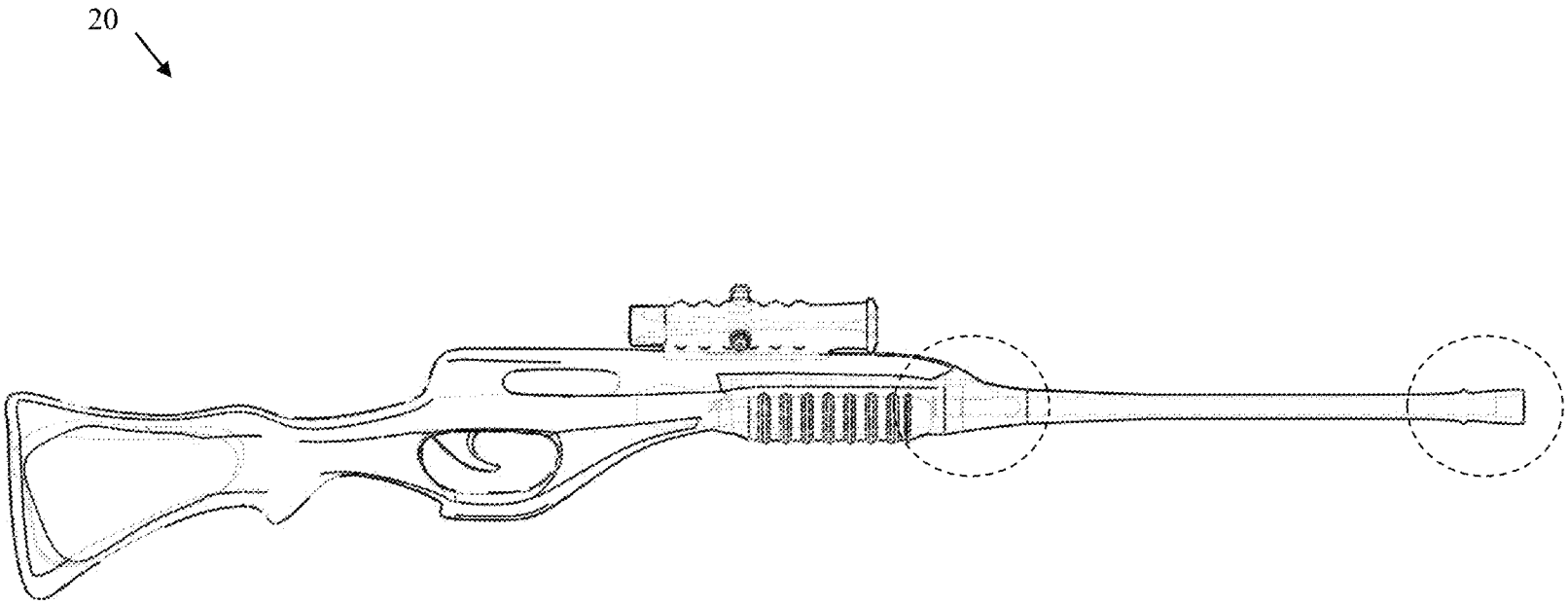
FIG. 5 is a schematic diagram illustrating a bullet within a conventional firearm.
Figure 6A:
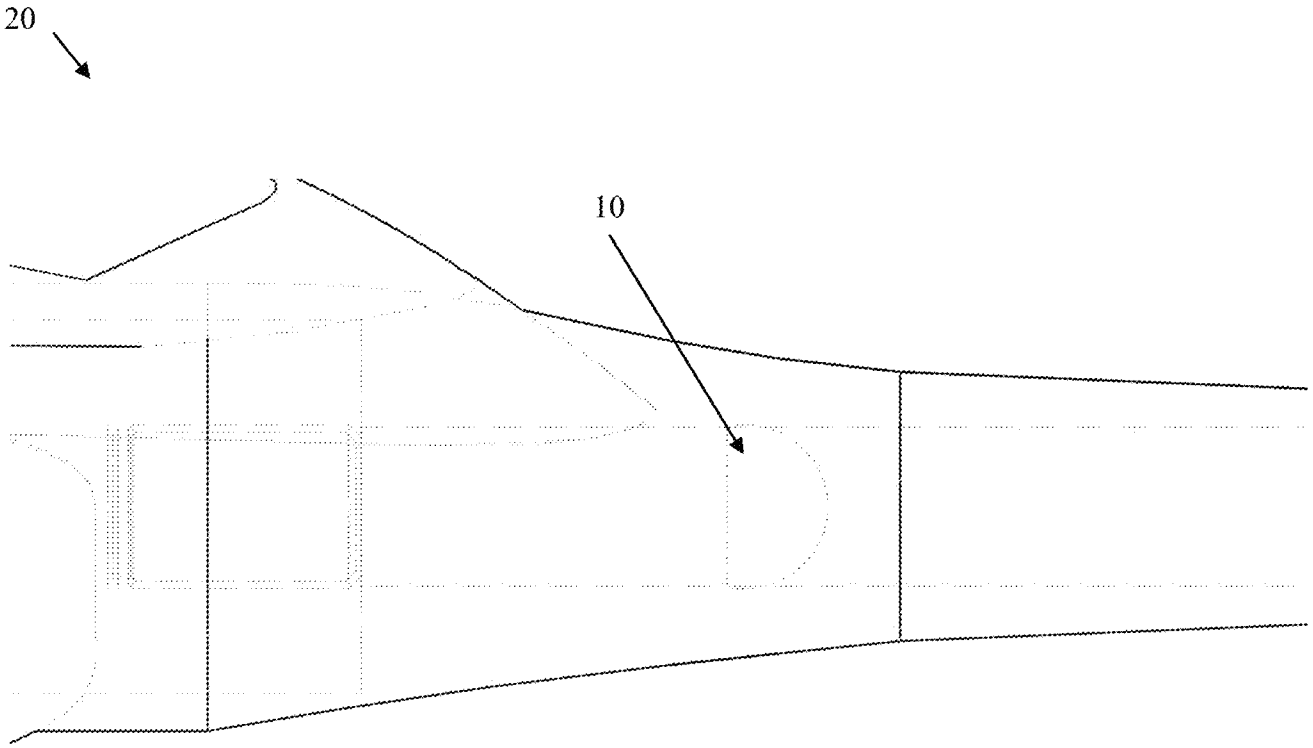
FIG. 6A is an enlarged detail view of item A within FIG. 5.
Figure 6B:
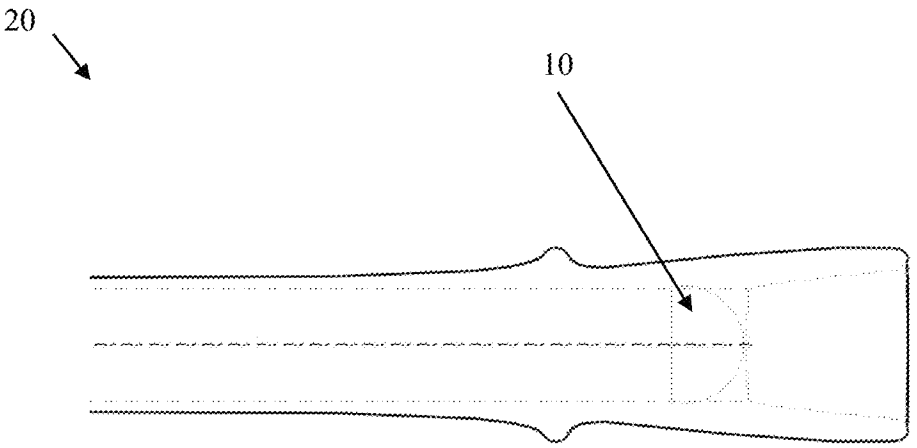
FIG. 6B is an enlarged detail view of item B within FIG. 5.
Figure 7A:
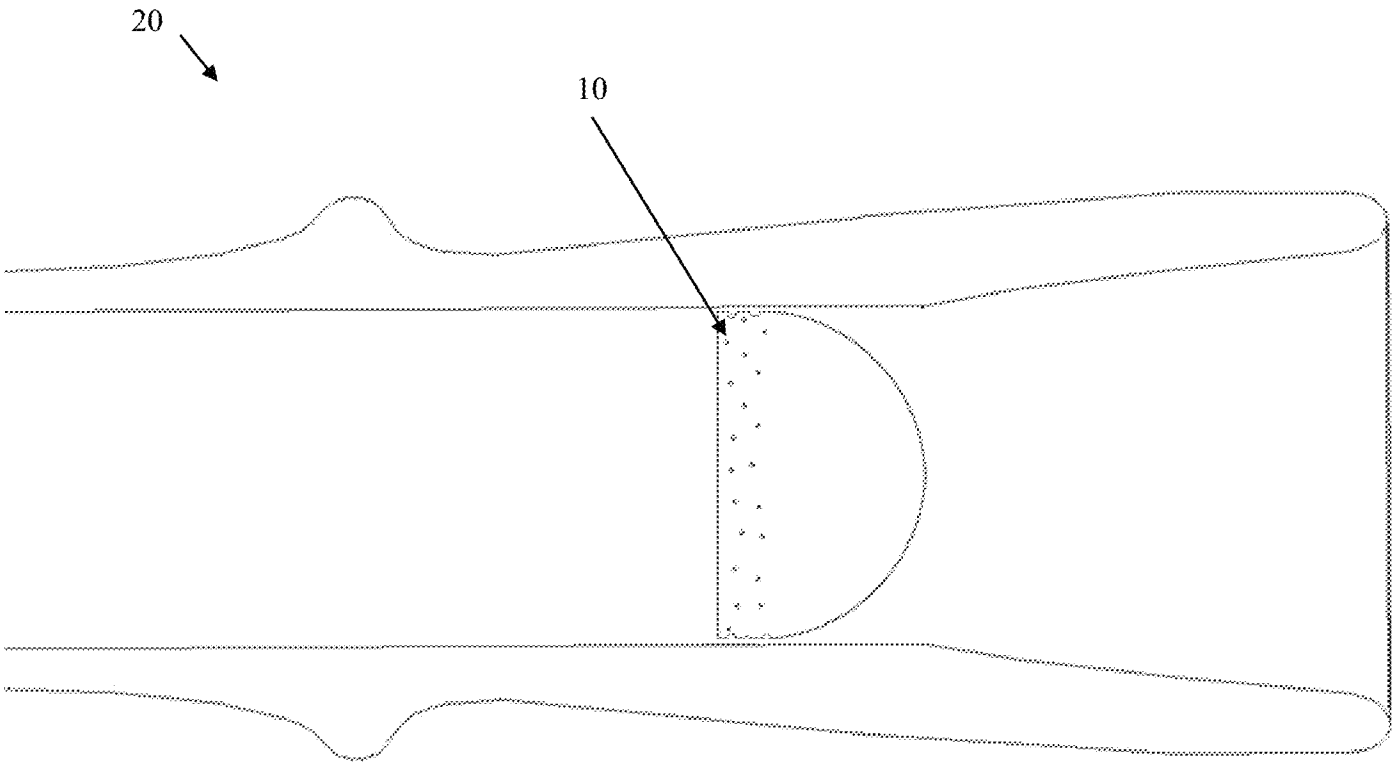
FIG. 7A is an enlarged detail view of item B within FIG. 5 with a conventional bullet disposed therein.
Figure 7B:
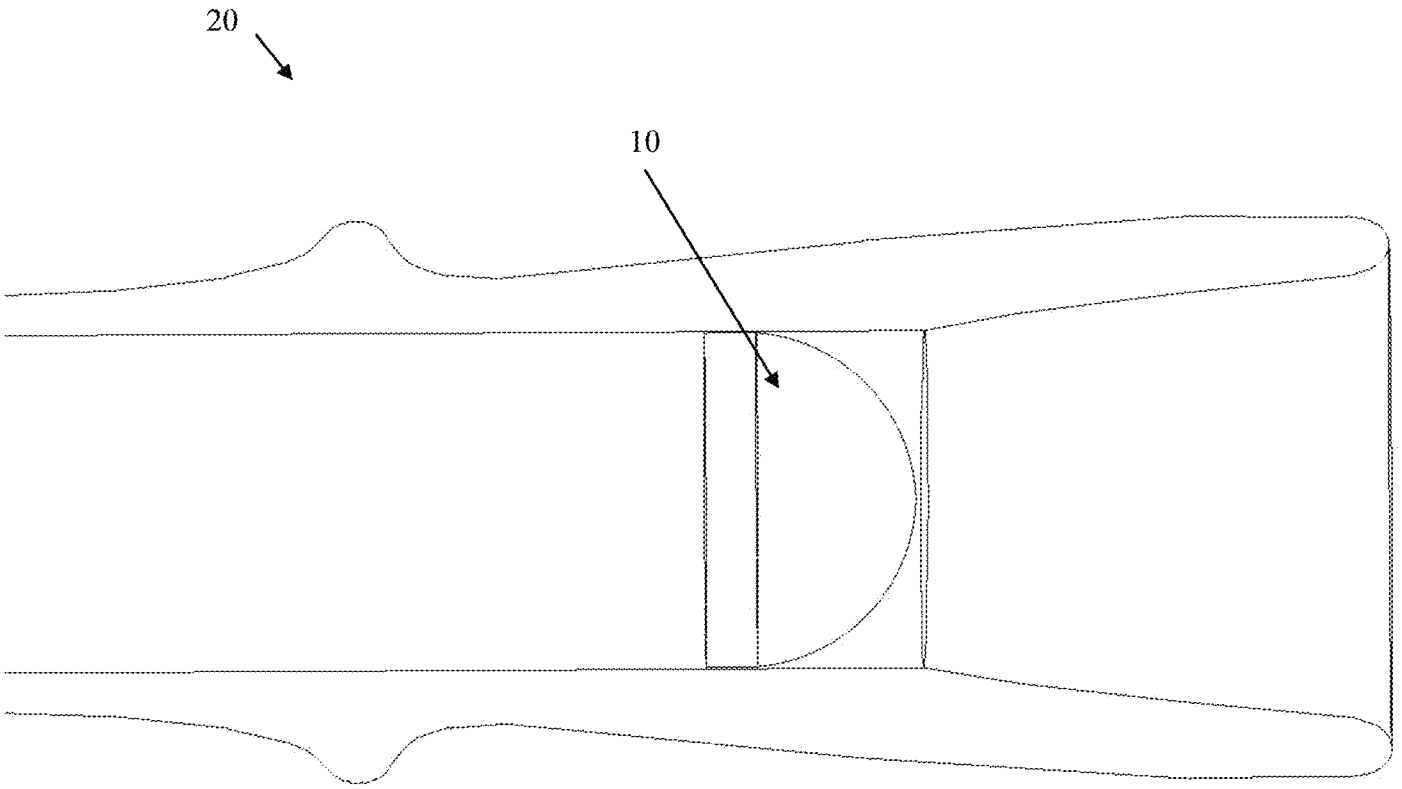
FIG. 7B is an enlarged detail view of item B within FIG. 5 with a conventional bullet processed according to the method illustrated in FIG. 4.

FIG. 5 is a schematic diagram illustrating a bullet 10 within a conventional firearm 20. FIG. 6A is an enlarged detail view of item A within FIG. 5 and FIG. 6B is an enlarged detail view of item B within FIG. 5. FIG. 7A is an enlarged detail view of item B within FIG. 5 with a conventional bullet disposed therein and FIG. 7B is an enlarged detail view of item B within FIG. 5 with a conventional bullet 10 processed according to the method illustrated in FIG. 4.

As illustrated in FIG. 7A, under magnification, the bullet 10 has a coarser grain structure as compared to the bullet 10 treated using the method according to the present invention. As a result, the bullet 10, shown in FIG. 7B, creates a tighter seal with an inner surface of the barrel, thereby resulting in significant increases in sealing capacities between said bullets 10 and gun barrels, ultimately resulting in higher travel velocity, axial symmetry and concentricity of the bullet in flight.

The present general inventive concept provides a system for thermal processing bullets to yield a refined grain structure, the system includes obtaining one or more bullet in a chamber, disposing the one or more bullets within the chamber having a temperature gradient between ambient temperature and cryogenic temperature, the chamber having a plurality of temperature zones, moving the one or more bullets between the plurality of temperature zones of the chamber at a predetermined rate, and returning the one or more bullets to the ambient temperature.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

What is claimed is:

1. A method for thermal processing bullets to yield a refined grain structure, the method comprising:

obtaining one or more bullets, each bullet comprising a bullet cartridge case detachably affixed to a bullet lead core jacketed with a gilding metal such that, upon firing the bullet, the bullet lead core with gilding metal jacket is propelled down a bore of a gun barrel;

disposing the one or more bullets within a chamber having a temperature gradient between ambient temperature and cryogenic temperature, the chamber having a plurality of temperature zones;

moving the one or more bullets between the plurality of temperature zones of the chamber at a predetermined rate, wherein at least one of the plurality of temperature zones is predetermined to cause a grain size of the bullet lead core with gilding metal jacket of the one or more bullets to be less than 50 microns; and returning the one or more bullets to the ambient temperature.

2. The method of claim 1, wherein the plurality of temperature zones includes a first temperature zone ranging from 60° F. to 80° F., a second temperature zone intermediate of 60° F. and −200° F. and a third temperature zone ranging from −200° F. to −459.67° F.

3. The method of claim 1, wherein the chamber includes a temperature reducing agent.

4. The method of claim 3, wherein the temperature reducing agent comprises at least one of liquid nitrogen, gaseous nitrogen, and dry ice.

5. The method of claim 1, wherein the one or more bullets are moved between the plurality of temperature zones of the chamber using a mechanical means including at least one of a ball screw mechanism, a pulley mechanism, and a conveyor mechanism.

6. The method of claim 1, wherein the predetermined rate is less than 5° F. per minute.

7. The method of claim 6, wherein internal structures of the one or more bullets are stress relieved after being moved between the plurality of temperature zones and then back to the ambient temperature.

8. The method of claim 6, wherein an external perimeter of the one or more bullets has a uniform compressive stress after being moved between the plurality of temperature zones and then back to the ambient temperature.

9. The method of claim 7, wherein a grain size of the bullet lead core with gilding metal jacket of the one or more bullets is less than 10 microns.

10. A method for thermal processing bullets to yield a refined grain structure, the method comprising:

obtaining one or more bullets, each bullet comprising a bullet cartridge case detachably affixed to a bullet lead core jacketed with a gilding metal such that, upon firing the bullet, the bullet lead core with gilding metal jacket is propelled down a bore of a gun barrel;

disposing the one or more bullets within a chamber configured to have a first temperature zone and a different second temperature zone, wherein the second temperature zone is predetermined to cause a grain size of the bullet lead core with gilding metal jacket of each of the one or more bullets to be less than 50 microns;

moving the one or more bullets from the first temperature zone to the second temperature zone of the chamber at a predetermined rate;

holding the one or more bullets within the second temperature zone for a predetermined time period; and returning the one or more bullets to the first temperature zone.

11. The method of claim 10, wherein the first temperature zone is ambient temperature and the second temperature zone is at cryogenic temperature.

12. The method of claim 11, wherein the first temperature zone ranges from 60° F. to 80° F. and the second temperature zone ranges from −200° F. to −459.67° F.

13. The method of claim 11, wherein the predetermined rate is less than 5° F. per minute.

14. The method of claim 13, wherein the predetermined rate is less than 3° F. per minute.

15. The method of claim 13, wherein the predetermined time period is 2 hours.

16. A method for thermal processing bullets to yield a refined grain structure, bullets, each bullet comprising a bullet cartridge case detachably affixed to a bullet lead core jacketed with a gilding metal such that, upon firing the bullet, the bullet lead core with gilding metal jacket is propelled down a bore of a gun barrel; the method comprising:

disposing a bullet within a chamber configured to expose the bullet to a first temperature and to a second temperature different from the first temperature, using a predetermined rate of temperature change, wherein the second temperature and the predetermined rate of temperature change are predetermined to cause a grain size of the bullet lead core with gilding metal jacket of the bullet to be 50 microns or less, to thereby reduce an adhesive stress and increase a sealing capacity between the bullet lead core with gilding metal jacket and a gun barrel;

moving a temperature of the bullet from the first temperature to the second temperature at the predetermined rate;

holding the bullet at the second temperature for a predetermined time period; and returning the temperature of the bullet to the first temperature.

17. The method of claim 16, wherein the predetermined rate of temperature change is less than 5° F. per minute.

18. The method of claim 16, wherein an external perimeter of the bullet has a uniform compressive stress after being moved between the first temperature and the second temperature and then back to the first temperature.

19. The method of claim 16, wherein internal structures of the bullet are stress relieved after being moved between the first temperature and the second temperature and then back to the first temperature.

20. The method of claim 16, wherein a grain size of the bullet lead core with gilding metal jacket of the bullet is less than 10 microns.

* * * * *